US005902159A

United States Patent [19]

Killpack et al.

[11] Patent Number: 5,902,159

[45] Date of Patent: May 11, 1999

[54] INBOARD/OUTBOARD MOTOR COOLING SYSTEM WINTERIZER

[76] Inventors: Tehren Killpack, 965 S. 820 East, Spanish Fork, Utah 84660; Dale Killpack, 483 N. 400 East, Firth, Id. 83236

[21] Appl. No.: 08/941,434

[22] Filed: Sep. 30, 1997

[51] Int. Cl.[6] ..... B63H 20/30

[52] U.S. Cl. ..... 440/88; 134/166 R

[58] Field of Search ..... 440/88; 114/222; 134/166 R, 167 R

[56] References Cited

U.S. PATENT DOCUMENTS

| | | | |
|---|---|---|---|
| 2,857,892 | 10/1958 | Hulsebus | 123/41.72 |
| 4,052,953 | 10/1977 | Patel | 134/167 |
| 4,271,874 | 6/1981 | Brady | 141/1 |
| 4,869,695 | 9/1989 | Sajdak, Jr. | 440/88 |
| 4,911,211 | 3/1990 | Andersen | 141/7 |
| 4,986,319 | 1/1991 | Ahlefeld | 141/98 |
| 5,035,208 | 7/1991 | Culp | 123/41.14 |
| 5,051,104 | 9/1991 | Guhlin | 440/88 |
| 5,069,259 | 12/1991 | Ahlefeld | 141/98 |
| 5,072,683 | 12/1991 | Colonna | 114/222 |
| 5,362,265 | 11/1994 | Gervais | 440/88 |
| 5,628,285 | 5/1997 | Logan et al. | 123/41.14 |
| 5,725,403 | 3/1998 | Ridolfo | 440/88 |

FOREIGN PATENT DOCUMENTS

| | | | |
|---|---|---|---|
| 56839 | 11/1990 | Australia | 440/88 |

*Primary Examiner*—Jesus D. Sotelo
*Attorney, Agent, or Firm*—Kirton & McConkie

[57] ABSTRACT

The invention is a device for flushing or winterizing an inboard/outboard engine cooling system having an open basin for submerging cooling system intake portals in liquid. The basin is capable of being removably and sealably disposed about a stern drive housing and allowing the stern drive housing of the motor to pass through bottom of the basin. The device also has elements for selectively and directionally conducting liquid discharged from the cooling system exhaust ducts into or away from the basin.

10 Claims, 4 Drawing Sheets

INBOARD/OUTBOARD MOTOR COOLING SYSTEM WINTERIZER

BACKGROUND OF THE INVENTION

1. The Field of the Invention

Many boat engines incorporate an engine cooling system which draws water from the body of water in which the boat is operated and pumps the water into the engine's cooling system. This cooling water is circulated through cavities and passageways within and about the engine and exhausted back into the body of water thereby cooling the engine. Typical boat engines withdraw cooling water from the body of water in which the boat is situated through intake portals in the stern drive portion of the drive mechanism. When the boat is resting in a body of water, the stern drive is below the water line and the intake portals are immersed in the water. Cooling water exits the cooling system through exhaust ducts which are typically found higher on the stern drive mechanism than the intake portals and not necessarily below the water line.

When a boat is removed from a body of water, some of this cooling water is retained within the cooling cavities and passageways of the engine. The presence of this retained water within the cooling system of the engine is typically not a problem when the boat is used frequently. However, when the boat is stored for a period of time, particularly in colder climates, this water can cause problems. Retained water within the engine cooling system can cause corrosion of engine parts and if allowed to freeze it can cause mechanical damage to the engine. Due to these risks, boat owners often replace the retained water by flushing out the retained water in the cooling system with fresh water and then winterize the boat engine. To winterize a boat engine means to replace the retained water in the cooling system with an anti-freeze/anti-corrosion lubricating solution.

2. The Relevant Technology

Several methods for flushing a boat engine's cooling system are known in the art. Most boat engines have drain plugs which can be removed, allowing the liquid in the cooling system to be drained out and be replaced. However, drain plugs are often difficult to remove while the engine is installed in a boat. Draining the cooling system in this manner also requires the removal of cooling system hoses. Even when the engine is drained in this manner, pockets of retained water often remain trapped within the cooling system chambers.

Another known method of replacing retained cooling water with antifreeze is immersing the stern drive portion of the engine in a large reservoir of antifreeze, completely submerging the intake portals, and running the engine until the cooling system is filled with antifreeze. However, this process is often impractical, requiring large amounts of antifreeze to fill bulky reservoirs or producing messy leaks that waste antifreeze and pollute the environment.

A third known method contemplates completely sealing off the intake portals and delivering antifreeze or liquid directly to the intake portals. This approach requires a complex device to deliver the liquid. Some devices deliver the liquid under pressure directly to the intake portals requiring a sufficiently liquid-tight seal be maintained around the intake portals. Maintaining the liquid-tight seal is difficult when the seal is under pressure and the seal often leaks profusely. If a non-pressurized delivery system is used to deliver the liquid directly to the intake portals, the supply of antifreeze to the intake portals is often inadequate and does not effectively and efficiently flush and winterize the engine's cooling system. Furthermore, if there is a need to change the kind of liquid being supplied to the system during the process, such as switching from water to antifreeze, this third method may require the user to shut off the engine or run the engine without any coolant while the source of liquid is changed.

Typically, once the antifreeze has been flushed through the cooling system using the methods described above, the antifreeze is discharged from exhaust ducts. Known methods of collecting the discharged antifreeze, such as placing a catch basin on the ground beneath the exhaust ducts, waste antifreeze, pollute the environment and require considerable clean up after use.

The present invention avoids the unnecessary waste and expense of the above mentioned methods by providing a practically-sized, open reservoir that fits with a waterproof seal around the stern drive to prevent leaks and pollution, submerges the intake portals and provides means for collecting and reusing antifreeze discharged from the exhaust ducts.

SUMMARY AND OBJECTS OF THE INVENTION

The present invention provides a removable basin, creating a reservoir, into which clean water and/or antifreeze can be placed and from which the engine cooling system will draw fluid while the engine is running. The reservoir can be made of a material which is inexpensive and the reservoir can be small in size so as to be lightweight, easy to use and easy to store. The reservoir is open to the atmosphere, not covered or otherwise under pressure. The basin or reservoir is removably disposed around the housing of the stern drive mechanism and secured to the housing with a seal that prevents leakage. The reservoir is disposed around a portion of the drive mechanism such that the drive mechanism passes through reservoir. Antifreeze placed in the reservoir will pool around and submerge the intake portals on the stern drive. The pool of antifreeze in the reservoir provides an uninterrupted supply of antifreeze to the intake portals. The uninterrupted supply of antifreeze is drawn into the engine through the intake portals by the engine's cooling system pump. The configuration of the reservoir, being disposed around a portion of the drive mechanism and the drive mechanism passing through reservoir, allows the user to winterize the engine without removing the drain plugs, cooling system hoses, propellers or other portions of the drive mechanism, without submerging the entire stern drive in a bulky reservoir, and without applying antifreeze under pressure directly to the intake portals.

Means for conducting the circulated antifreeze from the cooling system exhaust ducts back into the reservoir may be attached to the exhaust ducts thereby creating a closed loop in the coolant system, if desired. Using a closed loop system allows undiluted antifreeze to be used in the reservoir, obviating the need to dilute the antifreeze prior to flushing. As the undiluted antifreeze begins to circulate through the cooling system, the antifreeze mixes with the retained water already present in the cooling system. The retained water and antifreeze continue to mix as the liquid is discharged through the exhaust duct, conducted to the reservoir, and re-circulated through the engine's cooling system Conducting the antifreeze back to the reservoir using the means to directionally conduct the discharged antifreeze also helps prevent the antifreeze from being wasted or discharged into environmentally sensitive areas.

In order to properly flush a cooling system, the cooling system thermostat must be open. By employing a closed loop system, the water and antifreeze are re-circulated through the engine's cooling system as the engine runs. Recirculating the liquid into the cooling system causes the temperature of the water and antifreeze mix to rise, which in turn causes the temperature of the engine to rise. The higher engine temperature created by the closed loop ensures that the thermostat, if functional, will open which subsequently ensures that all parts of the cooling system contain antifreeze solution to protect against freezing and corrosion during storage. Re-circulation of antifreeze provides an uninterrupted supply of antifreeze to the intake portals and does so using a minimum amount antifreeze.

The invention may also be used to flush out the cooling system with fresh water or any other desired liquid.

In order to use the invention, the basin forming the reservoir is disposed around the stern drive just below the coolant intake portals and securely fastened to form a liquid-tight seal around the stern drive. Hoses are then attached to the engine cooling system exhaust ducts. Preferably one-inch, clear hoses are used. In use, the unattached ends of the hoses are allowed to dangle free of the reservoir, directing the flow of water from the exhaust onto the ground. The reservoir is continuously supplied with fresh, clean water from any convenient source and the boat engine allowed to run until the engine reaches normal operating temperature.

After the system has been flushed with clean water, the hoses are rearranged so that the exhaust hoses direct flow into the reservoir. The engine's operating temperature is raised by directing the flow from the exhaust hoses back into the reservoir. This ensures that the system is flushed out and the thermostat is open. Care should be taken that the engine does not overheat to temperatures which could harm the engine. Undiluted antifreeze is placed into the reservoir. The antifreeze is then drawn into the cooling system and allowed to circulate and re-circulate throughout the system. After the antifreeze has been sufficiently circulated throughout the cooling system, the antifreeze mixture can be tested with a conventional antifreeze tester to assure that the desired level of freeze protection is achieved. The mixture of antifreeze to water in the reservoir is indicative of the mixture throughout the cooling system. Thus, because the reservoir is open, the mixture of antifreeze to water can be quickly and easily monitored and antifreeze or water can be easily added to the mixture as necessary.

The boat engine is turned off. The reservoir is emptied by pouring the liquid out of reservoir. This can be done while the reservoir remains conveniently attached to the stern drive by merely lifting and tilting the boat's stern drive, causing the liquid in the reservoir to be poured cleanly into a receptacle. Alternatively, the reservoir can be manufactured with a drain and plug for removing the liquid or diluted antifreeze remaining in the reservoir. After the reservoir is emptied, the reservoir and hoses are removed from the stern drive. The diluted antifreeze from the reservoir can be reused in other engines, such as an automobile engine.

It will be appreciated that the device can also be used to dewinterize the engine when the boat is brought out of storage. Dewinterizing a boat engine means to replace the antifreeze in the cooling system with fresh water. The invention allows antifreeze to be flushed from the boat engine by running the engine while continuously supplying the reservoir with fresh water until the thermostat opens. When the thermostat opens, the antifreeze in the cooling system will begin to be flushed out and discharged through the hoses attached to the exhaust ducts. The antifreeze can then be directed into a receptacle and prevented from spilling into environmentally sensitive areas.

It is an object of the present invention to provide a device for flushing or winterizing an engine cooling system without having to remove the cooling system drain plugs, cooling system hoses, propellers or other parts of the drive mechanism and without having to dilute antifreeze before adding it to the cooling system, by providing a reservoir which is disposed about the stern drive housing, the stern drive housing passing through the reservoir.

It is also an object of the present invention to provide a device for flushing or winterizing an engine cooling system quickly and efficiently using a minimal amount of antifreeze by providing an open reservoir for submerging cooling system intake portals in liquid.

It is another object of the present invention to provide a device for flushing, winterizing or dewinterizing an engine cooling system that does not discharge the antifreeze into the environment by providing means for selectively and directionally conducting liquid discharged from the cooling system into or away from the reservoir.

It is still another object of the present invention to provide a device for flushing or winterizing, an engine cooling system that is inexpensive to manufacture, simple to use, and easy to store.

It is an object of the present invention to provide a device for flushing or winterizing an engine cooling system that minimizes clean up associated with flushing or winterizing an engine.

It is an object of the present invention to provide a device for flushing or winterizing an engine cooling system that maintains an uninterrupted supply of coolant to the cooling system in an amount sufficient to properly flush or winterize the system.

BRIEF DESCRIPTION OF THE DRAWINGS

In order that the manner in which the above-recited and other advantages and objects of the invention are obtained, a more particular description of the invention briefly depicted above will be rendered by reference to a specific embodiment thereof which is illustrated in the appended drawings. With the understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 2:
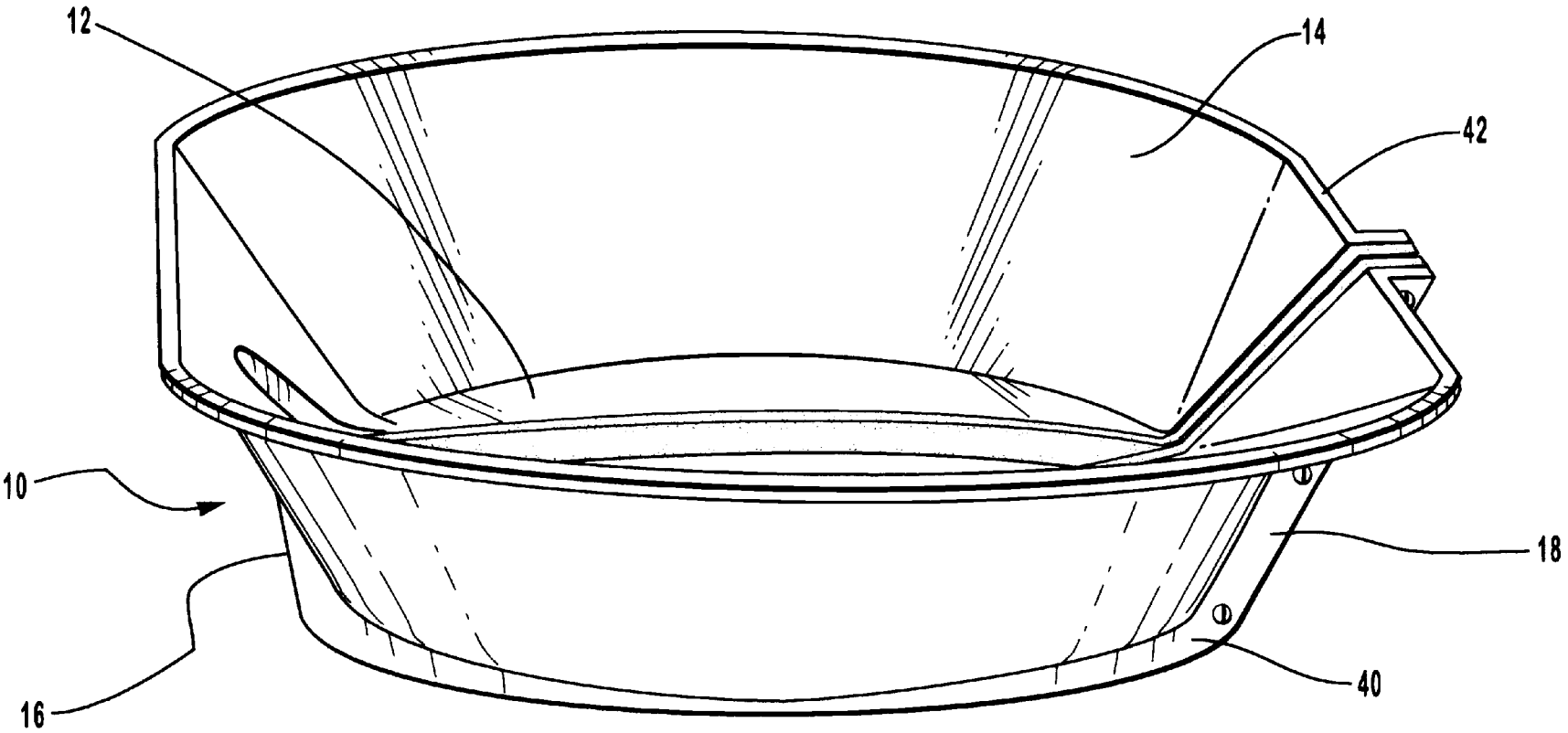
FIG. 2 is a perspective view of the invention.
Figure 3:
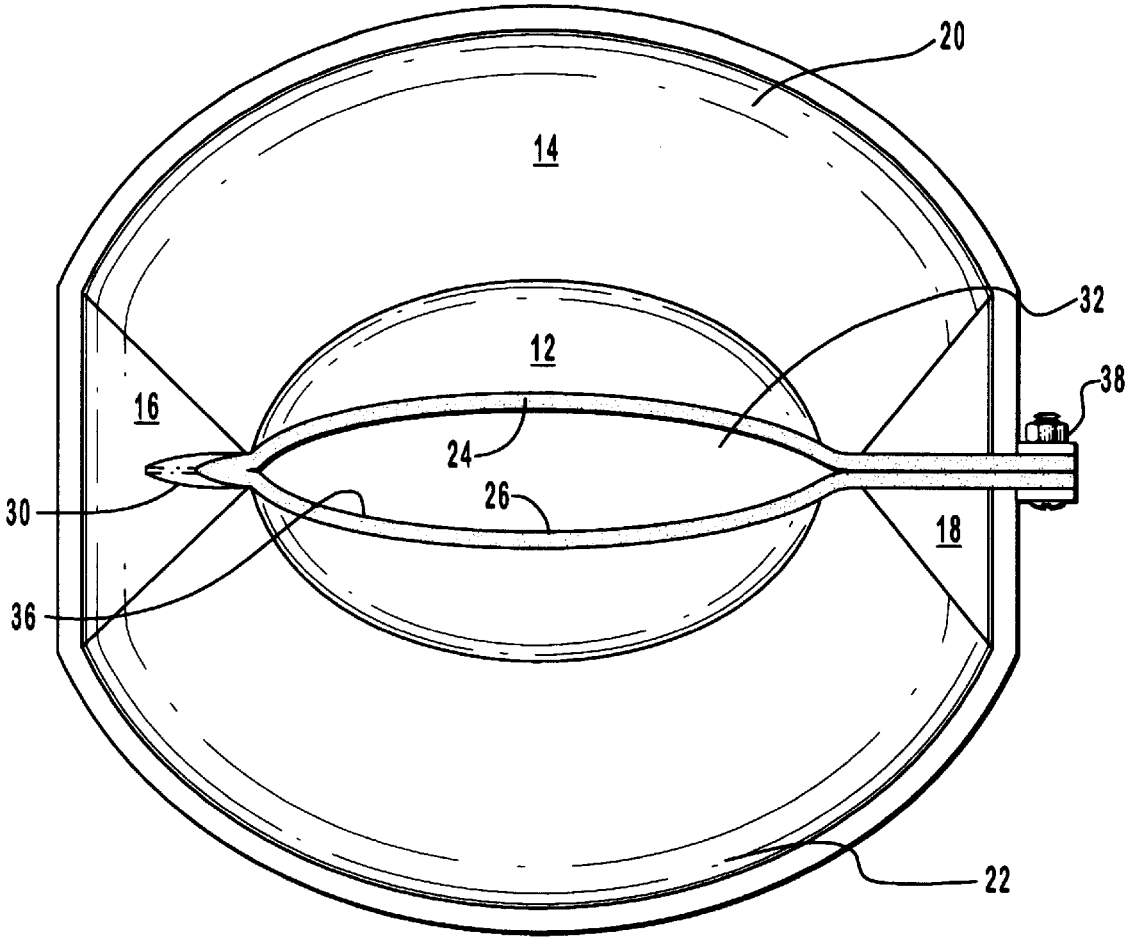
FIG. 3 is a top view of the invention.

FIG. 2 shows a substantially elliptically shaped basin 10 having a floor 12 and sloping sidewall 14. Basin 10 has a hinged end 16 and a fastening end 18. FIG. 3 shows basin 10 is divided longitudinally into a first half 20 and a second half 22, first half 20 defining a first edge 24 and second half 22 defining a second edge 26. Edges 24 and 26 run from a hinge 30 on hinged end 16, across floor 12 to fastening end 18, and up sidewall 14 on fastening end 18. First half 20 and second half 22 are releasably attached to each other at fastening end 18. First half 20 and second half 22 can be drawn apart from each other, opening from fastening end 18, but remaining attached at hinged end 16. Basin 10 is constructed of sufficiently pliable material so as to permit the opening and closing about hinged end 16 at fastening end 18. When halves 20 and 22 are separated at fastening end 18, basin 10 is substantially U-shaped.

Figure 1:
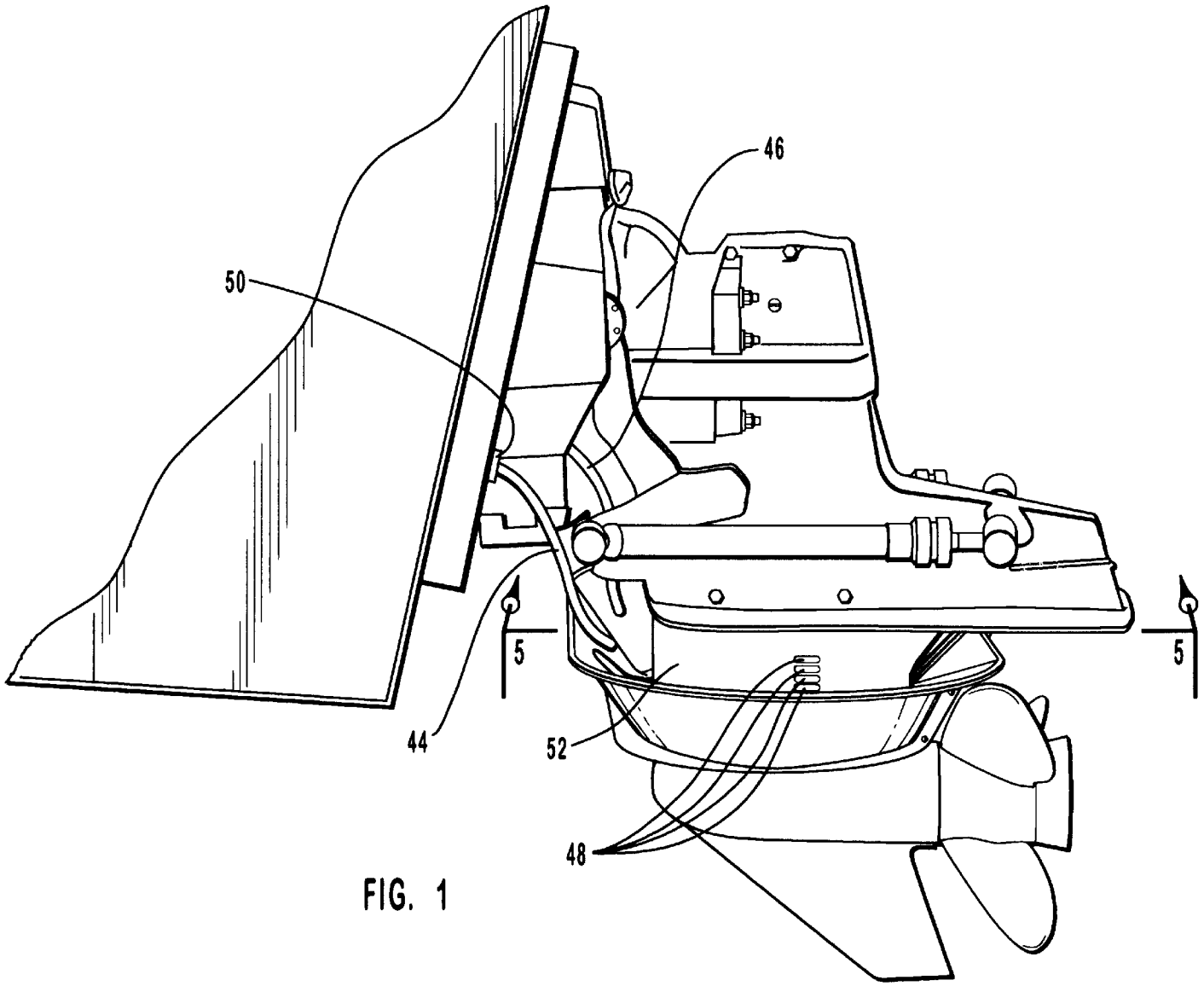
FIG. 1 is a perspective view of the invention disposed about the stern drive housing of an inboard/outboard motor.
Figure 5:
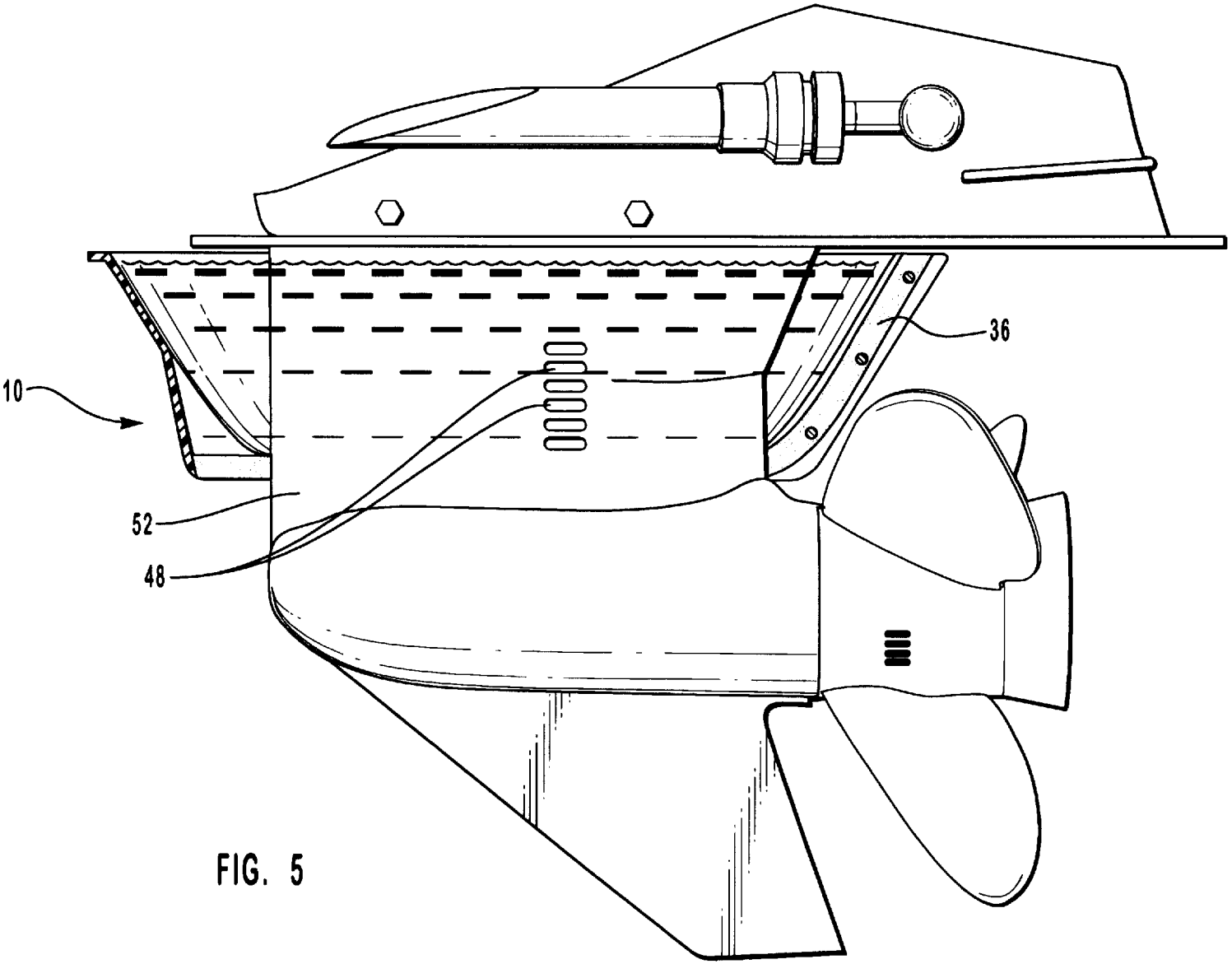
FIG. 5 is a side view of the invention in partial section, mounted on the stern drive housing, showing fluid in the reservoir.

When halves 20 and 22 are joined together at fastening end 18, first edge 24 and second edge 26 contact each other at fastening end 18. However, along floor 12, first edge 24 and second edge 26 do not contact each other; edges 24 and 26 define an elliptical opening 32 in floor 12, as illustrated in FIG. 3. FIGS. 1 and 5 illustrate that opening 32 is of sufficient size and shape to be compatible to and co-extensive with the exterior shape of a stern drive mechanism. When the basin 10 is disposed about the stern drive, stern drive housing 52, passes through basin 10.

A lining 36, made of resilient material such as closed cell foam or rubber, is attached to edges 24 and 26 shown in FIG. 3. When basin 10 is fastened around the housing of a stern drive mechanism, the lining 36 forms a liquid-proof seal around the stern drive housing 52 as illustrated in FIG. 5.

Figure 4:
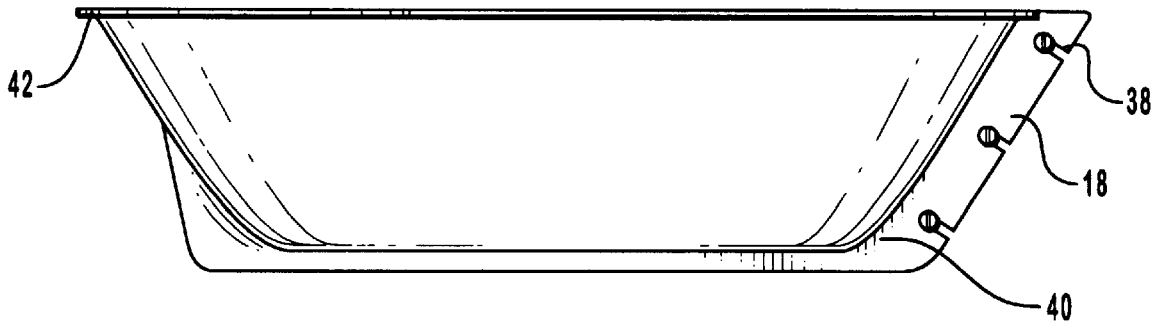
FIG. 4 is a side view of the invention.

FIG. 4 illustrates fastening end 18 having means 38 for releasably fastening halves 20 and 22 together. FIG. 3 illustrates a nut and bolt configuration for fastening halves 20 and 22 together. Any binding mechanism can be utilized to releasably fasten halves 20 and 22 together at fastening end 18 so long as the proper seal along the edges 24 and 26 is achieved. For example, a clamping mechanism (not shown) could be employed. In an alternative embodiment (not shown), basin 10 could have two completely separable halves 20 and 22 with a first fastening end and a second fastening end at opposing ends of basin 10 without a hinge 30.

In the preferred embodiment, basin 10 is constructed of a flexible, lightweight, plastic. The hinge 30 can be manufactured to be integral with hinged end 16 and floor 12 or may be a separate hinge component.

When properly disposed about the stern drive, basin 10 forms a reservoir near the cooling system intake portals 48 such that intake portals 48 are submerged when the reservoir is filled with liquid, as shown in FIG. 5.

FIG. 1 illustrates means for directionally conducting liquid from the exhaust ducts 50 of the cooling system of the engine into the basin 10. The embodiment of the invention in FIG. 1 illustrates two, clear, one-inch tubes 44 and 46 releasably attached to the exhaust ducts 50 and conducting liquid back to the basin 10.

A flange 40 along edges 24 and 26, as shown in FIG. 2, increases the surface area of edges 24 and 26 and allows for a larger and more secure lining 32 to be attached, which in turn creates a better seal along edges 24 and 26.

A rim 42 at the top of sidewall 14, as shown in FIG. 2, provides rigidity to basin 10.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by united states letters patent is:

1. A device for flushing or winterizing an inboard/outboard engine cooling system comprising:

an open basin for submerging cooling system intake portals in liquid, said basin capable of being removably and sealably disposed about a stern drive housing and allowing the stern drive housing of the motor to pass through bottom of the basin; and means for selectively and directionally conducting liquid discharged from the cooling system exhaust ducts into or away from the basin.

2. The device of claim 1, the basin further comprising a first half;

a second half; and means for releasably fastening the first half and second half together, the first half being attached to the second half by a hinge at a hinged end, and the first half being releasably fastened to the second half at a fastening end.

3. The device of claim 2, wherein the hinge is integral with the basin.

4. The device of claim 2, wherein the means for releasably fastening the first half to the second half further comprises a nut and a bolt configuration.

5. The device of claim 2, the first half further comprising a first edge and the second half further comprising a second edge, the first and second edges defining an opening compatible to and coextensive with the exterior shape of the stern drive housing to form a liquid-tight seal about the stern drive housing and to allow the stern drive housing to pass through the basin.

6. The device of claim 5 further comprising a flange formed along the first and second edges.

7. The device of claim 5, further comprising a resilient lining attached to the first and second edges.

8. The device of claim 6, further comprising a resilient lining attached to the flange formed along the first and second edges.

9. The device of claim 1, the basin further comprising a first half and a second half, the first half being releasably attached to the second half by means for fastening on a first fastening end and means for fastening on a second fastening end.

10. The device of claim 1, the means for directionally conducting liquid comprising tubing to conduct liquid discharged from the cooling system exhaust ducts.

* * * * *